US006632074B2

(12) United States Patent
Murakami et al.

(10) Patent No.: US 6,632,074 B2
(45) Date of Patent: Oct. 14, 2003

(54) PRESSURE SETTING MEANS FOR A MULTISTAGE TYPE PISTON COMPRESSOR

(75) Inventors: Kazuo Murakami, Kariya (JP); Yoshiyuki Nakane, Kariya (JP); Susumu Tarao, Kariya (JP); Kenichi Morita, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/936,199

(22) PCT Filed: Jan. 10, 2001

(86) PCT No.: PCT/JP01/00054

§ 371 (c)(1),
(2), (4) Date: Sep. 10, 2001

(87) PCT Pub. No.: WO01/51809

PCT Pub. Date: Jul. 19, 2001

(65) Prior Publication Data

US 2003/0059316 A1 Mar. 27, 2003

(30) Foreign Application Priority Data

Jan. 11, 2000 (JP) ..... 2000-002970

(51) Int. Cl.[7] ..... F04B 25/00
(52) U.S. Cl. ..... 417/254; 417/269; 417/222.1
(58) Field of Search ..... 417/254, 269, 417/222.1, 271

(56) References Cited

U.S. PATENT DOCUMENTS 4,495,855 A 1/1985 Murakami et al. ..... 92/71
5,921,756 A * 7/1999 Matsuda et al. ..... 417/269
5,931,645 A * 8/1999 Goto et al. ..... 414/269
6,079,952 A * 6/2000 Harte et al. ..... 417/253
6,183,211 B1 * 2/2001 Wood ..... 417/254
6,280,151 B1 * 8/2001 Murakami et al. ..... 417/269

FOREIGN PATENT DOCUMENTS

JP 63-10307 3/1988 ..... 92/71
JP 10-176671 6/1998 ..... 417/269
JP 10-184539 7/1998 ..... 417/269

* cited by examiner

*Primary Examiner*—Cheryl J. Tyler
(74) *Attorney, Agent, or Firm*—Morgan & Finnegan, LLP

(57) ABSTRACT

A multistage piston compressor includes a case and a suction chamber and a discharge chamber provided in the case. A rotary shaft is supported in the case. A valve plate provided in the case includes suction ports and discharge ports. A plurality of bores are provided at predetermined intervals about the axis of the shaft. Pistons are housed in the bores and compress refrigerant by reciprocating in accordance with the rotation of the shaft. An intermediate chamber connects a discharge port with a suction port. The refrigerant is compressed in stages by passing through a plurality of bores via the intermediate chamber. Compression chambers are defined between the pistons and the valve plate. A communication passage is provided for setting the pressures acting on the rear faces of the pistons to an intermediate pressure between the suction pressure and the discharge pressure.

11 Claims, 2 Drawing Sheets

PRESSURE SETTING MEANS FOR A MULTISTAGE TYPE PISTON COMPRESSOR

BACKGROUND OF THE INVENTION

The present invention relates to a multistage piston compressor used in, e.g., a vehicular air-conditioning system.

Japanese Unexamined Patent Publication No. Hei 10-184539 discloses a conventional multistage piston compressor. This kind of compressor is provided with a rotary shaft, which is rotatably supported in a case. A valve plate is provided in the case. The valve plate has a plurality of discharge ports and suction ports. A plurality of bores are arranged at predetermined intervals on a circle, the center of which is on the axis of the rotary shaft. A reciprocating piston is housed in each bore. Each piston is connected with a swash plate by a pair of shoes. When the rotary shaft is rotated, the swash plate rotates. The rotation of the swash plate is converted into reciprocating motion of the pistons in the bores by the shoes. A connecting passage connects the discharge port of one bore with the suction port of another bore. A refrigerant passes through a plurality of cylinder bores successively via the connecting passage and is compressed in a multiple stages.

Between an end face of the pistons and the valve plate, compression chambers are defined in the bores. When the difference between the pressure in one of the compression chambers and the pressure in a crank chamber is large, the refrigerant is likely to leak through the gap between the bore and the piston. As a result, since a large amount of blow-by gas, or leakage loss occurs, the performance of the compressor falls.

When the difference between the pressure in the compression chamber and the pressure in the crank chamber is large, the difference between the pressure acting on the front face of the piston and the pressure acting on the rear face of the piston is large. In this case, the piston receives a large compressive reaction force. The compressive reaction force produces a large frictional force between the shoes and the swash plate and between the shoes and the piston. Furthermore, the reaction force acts also on the rotary shaft, to which the swash plate is fixed. Therefore, a mechanical loss is generated and the performance of the compressor falls.

SUMMARY OF THE INVENTION

An object of the present invention is to provide a multistage piston compressor that decreases the leakage loss and the mechanical loss.

In order to achieve the above object, the present invention provides the following multistage piston compressor: The compressor includes a case, a suction chamber, which is provided in the case and the internal pressure of which is a suction pressure, and a discharge chamber, which is provided in the case and the internal pressure of which is a discharge pressure. A rotary shaft is rotatably supported in the case. A valve plate is provided in the case. The valve plate includes suction ports and discharge ports. A plurality of bores are provided at predetermined intervals about the axis of the rotary shaft. Pistons are housed in the bores and reciprocate therein in accordance with the rotation of the rotary shaft to compress a refrigerant. A connecting passage connects the discharge port of a specific bore with the suction port of another bore. The refrigerant passes through a plurality of bores via the connecting passage and is compressed in a multistage manner. A compression chamber is defined between an end face of each piston and the valve plate. Pressure setting means sets the pressure acting on the rear face of the piston to an intermediate pressure between the suction pressure and the discharge pressure.

DETAILED DESCRIPTION OF THE PREFERRED EMBODIMENTS

An embodiment in which the present invention is embodied in a multistage piston compressor using carbon dioxide as a refrigerant will be described with reference to FIGS. 1 and 2.

Figure 1:
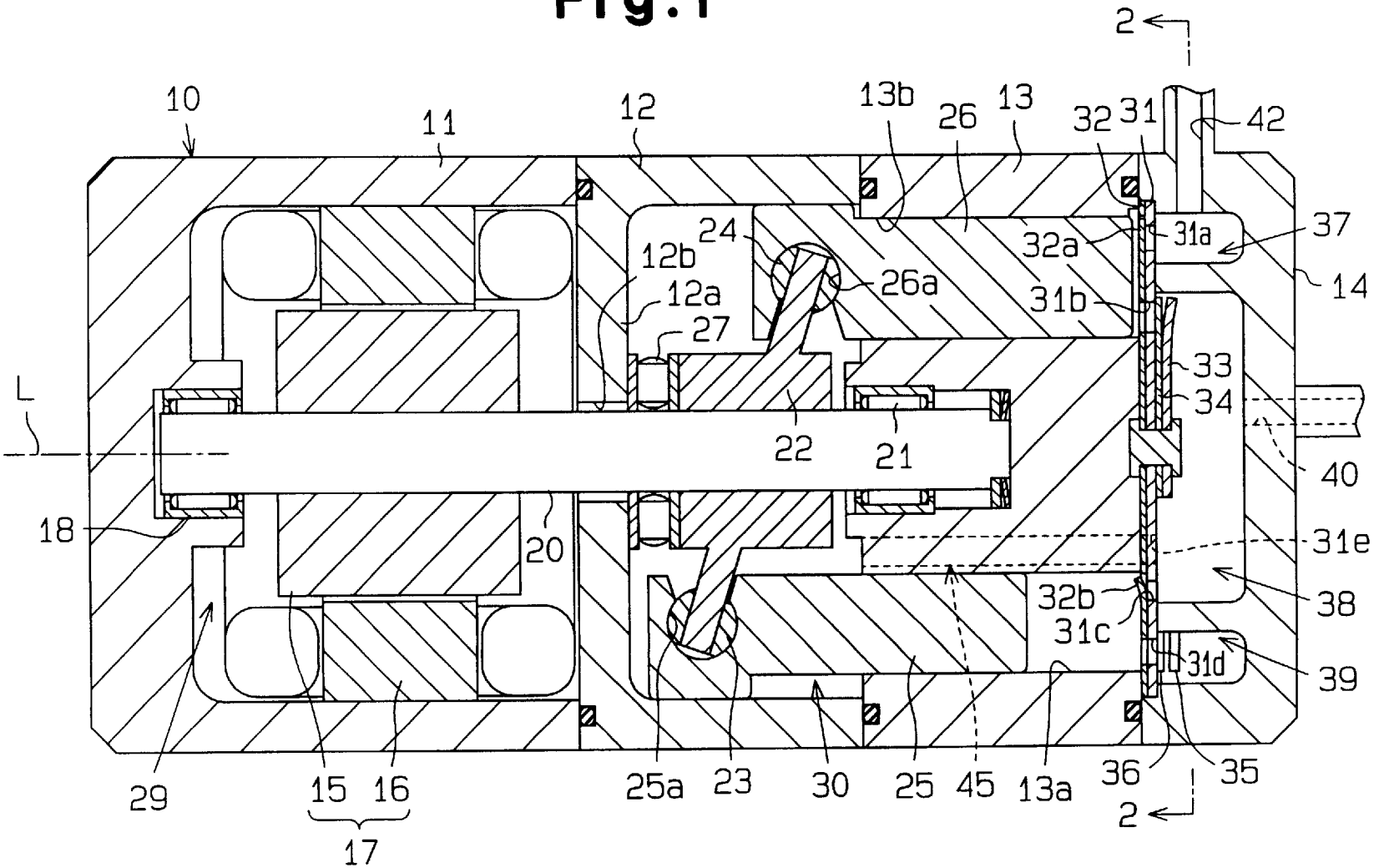
FIG. 1 is a sectional view of a multistage piston compressor according to an embodiment of the present invention.
Figure 2:
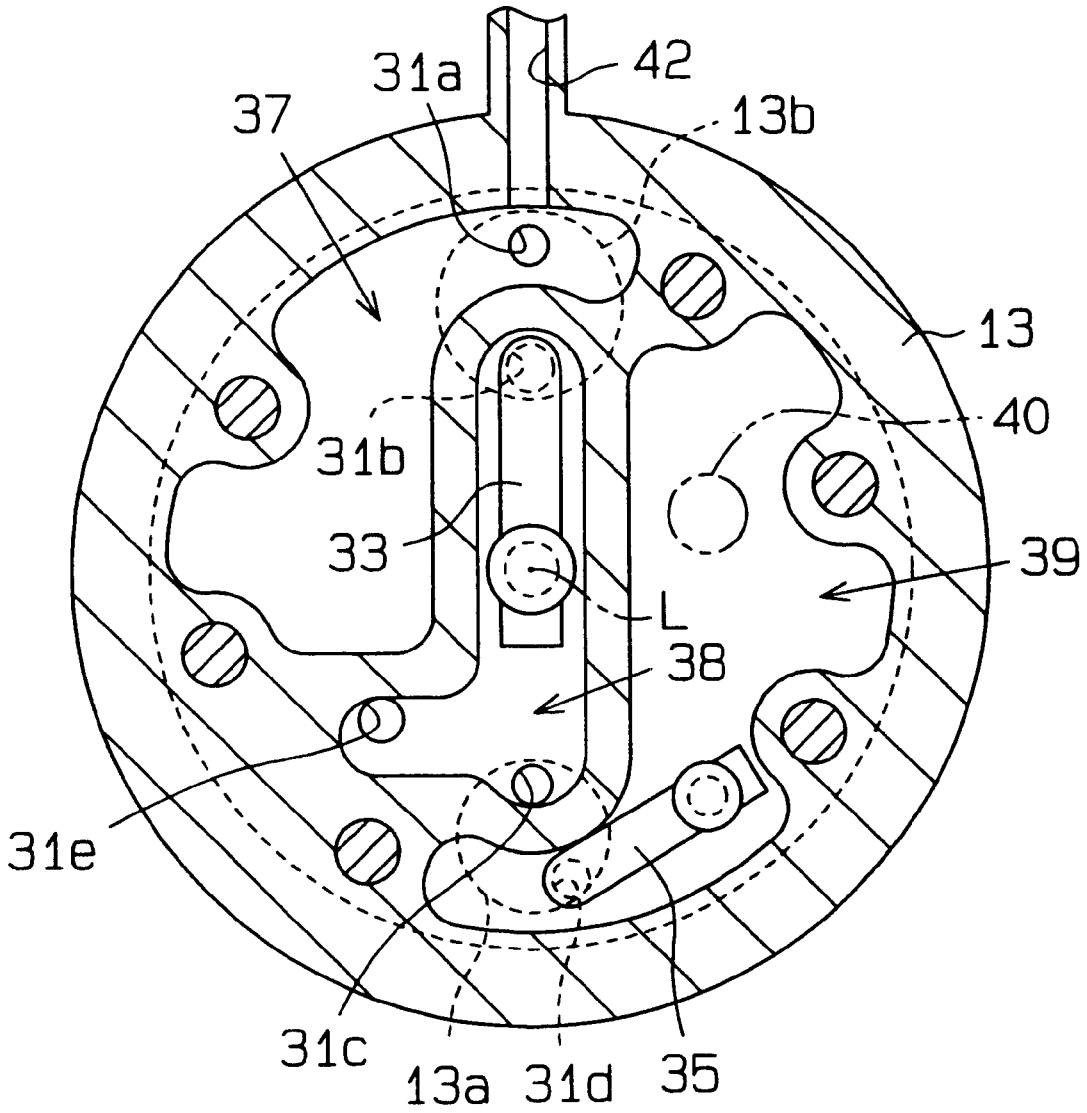
FIG. 2 is a sectional view along the line 2—2 in FIG. 1.

As shown in FIG. 1, a housing of a cylindrical compressor 10 includes a motor housing member 11, a front housing member 12, a cylinder block 13 and a rear housing member 14.

Between the motor housing member 11 and the cylinder block 13, a rotary shaft 20 is supported by bearings 18, 21. The rotary shaft 20 passes through a center hole 12*b* of a wall portion 12*a* formed in the front housing member 12.

Between the motor housing member 11 and the front housing member 12, a motor chamber 29 is defined. In the motor chamber 29, an electric motor 17 is housed. The electric motor 17 is provided with a rotor 15 and a stator 16.

The cylinder block 13 has a first bore 13*b* and a second bore 13*a*. The first bore 13*b* is larger in diameter than the second bore 13*a*. As shown in FIG. 2, the bores 13*a*, 13*b* are located at positions substantially opposed to each other with respect to the axis L of the rotary shaft 20.

As shown in FIG. 1, a crank chamber 30 is defined between the front housing member 12 and the cylinder block 13. In the crank chamber 30, a disk-like swash plate 22 is fixed on the rotary shaft 20. The swash plate 22 is supported in a thrust direction by a bearing 27, which contacts the rear face of the wall 12*a* of the front housing member 12. In the respective bores 13*a*, 13*b*, corresponding pistons 25, 26 reciprocate.

The pistons 25, 26 are provided with grooves 25*a*, 26*a*, respectively. In each groove 25*a*, 26*a*, a pair of semispherical shoes 23, 24 is provided. The swash plate 22 is fitted between the shoes 23 and 24. In this embodiment, a crank mechanism is formed by the swash plate 22, the grooves 25*a*, 26*a* and the shoes 23, 24.

A suction passage 42 and a discharge passage 40 are formed in the peripheral wall and end wall of the rear housing member 14, respectively. Between the rear housing member 14 and the cylinder block 13, a suction chamber 37, an intermediate chamber 38 and a discharge chamber 39 are defined. As shown in FIGS. 1 and 2, the suction chamber 37 is connected with the suction passage 42. The intermediate chamber 38 functions as a connecting passage for connecting the bores 13*a* and 13*b*. The discharge chamber 39 is connected with the discharge passage 40. Between the rear housing member 14 and the cylinder block 13, a first valve plate 31 and a second valve plate 32 are provided. The first valve plate 31 is provided with five ports 31*a*, 31*b*, 31*c*, 31*d* and 31*e*.

The port 31*a* connects the suction chamber 37 to the first bore 13*b*. The port 31*b* connects the first bore 13*b* to the intermediate chamber 38. The port 31*c* connects the second bore 13*a* to the intermediate chamber 38. The port 31*d* connects the second bore 13*a* to the discharge chamber 39. The port 31*e* connects a communication passage 45, which will be described later, to the intermediate chamber 38.

In the second valve plat 32, suction valves 32*a*, 32*b* are formed at the positions corresponding to the ports 31*a*, 31*c* of the first valve plate 31. The suction valves 32*a*, 32*b* open and close the respectively corresponding ports 31*a*, 31*c*. In the rear housing member 14, discharge valves 34, 36 are provided at positions respectively corresponding to the ports 31*b*, 31*d*. Retainers 33, 35 are fixed to cylinder block 13.

In the cylinder block 13, a communication passage 45 is formed to serve as pressure setting means for connecting the crank chamber 30 to the intermediate chamber 38. Therefore, the crank chamber 30 communicates with the intermediate chamber 38 through the communication passage 45 and further communicates with the motor chamber 29 through a gap in the bearing 27 and the center hole 12*b*.

Next, the operation of the compressor of this embodiment will be described.

When the rotary shaft 20 is rotated by the electric motor 17, the swash plate 22 rotates. The rotation of the swash plate 22 is converted into reciprocating motion of the pistons 25, 26 through the shoes 23, 24. When the piston 26 moves from its top dead center position to its bottom dead center position, i.e., during the suction stroke, the refrigerant that enters through the suction passage 42 into the suction chamber 37 forces the suction valve 32*a* to open and then flows into the first bore 13*b*. By the rotation of the swash plate 22, the piston 26 moves from its bottom dead center position toward its top dead center position to compress the refrigerant in the first bore 13*b*. This is the first stage of compression. Next, when the piston 26 has moved near its top dead center position as shown in FIG. 1, the discharge valve 34 is opened so that the compressed refrigerant in the first bore 13*b* flows into the intermediate chamber 38.

Some of the refrigerant in the intermediate chamber 38 passes through the port 31*e* and the communication passage 45 into the crank chamber 30. Further, the refrigerant is supplied from the crank chamber 30 to the motor chamber 29 through the bearing 27 and the hole 12*b* of the front housing member 12.

On the other hand, when he piston 25 moves towards its bottom dead center position, the refrigerant in the intermediate chamber 38 forces the suction valve 32*b* to open, so that the refrigerant enters the second bore 13*a*. Next, when the piston 25 moves toward its top dead center position, it compresses the refrigerant in the second bore 13*a*. This is the second stage of compression. When the piston 25 has moved near its top dead center position, the discharge valve 36 is opened so that the compressed refrigerant is discharged into the discharge chamber 39. The co pressed refrigerant is then supplied through the discharge passage 40 to another part, not shown, of the air-conditioning system, e.g., a condenser.

This embodiment has the effects described below.

Since the communication passage 45 connects the crank chamber 30 to the intermediate chamber 38, the pressure in the crank chamber 30 becomes almost equal to the pressure in the intermediate chamber 38. That is, the pressure in the crank chamber 30, or the pressure acting on the rear face of the piston 25, is set to an intermediate pressure that is higher than the suction pressure (the pressure in the suction chamber 37) and lower than the discharge pressure (the pressure in the discharge chamber 39). Therefore, the difference between the pressure in the crank chamber 30 and the pressure in the compression chamber of the first bore 13*b* is small. As a result, the refrigerant in the compression chamber scarcely leaks into the crank chamber 30. Also, the difference between the pressure of the refrigerant compressed in the compression chamber of the second bore 13*a* and the pressure in the crank chamber 30 is also small. Therefore, the compressed refrigerant in the compression chamber of the second bore 13*a* hardly leaks into the crank chamber 30. Thus, the gas leakage through the gaps between the pistons 25, 26 and the first and second bores 13*b*, 13*a* is reduced. Also, since the differences in pressure between the crank chamber 30 and the compression chambers in both bores 13*a*, 13*b* is small, the compressive reaction forces due to reciprocation of the pistons 25, 26 also become small, and mechanical losses are reduced.

With only the simple construction of providing the communication passage 45 between the crank chamber 30 and the intermediate chamber 38, the pressure in the crank chamber 30 can be set to substantially the same pressure as the pressure in the intermediate chamber 38.

Since the refrigerant, which contains lubricating oil, passes through the bearing 27, a sufficient amount of lubricating oil is supplied between the bearing 27 and the rotary shaft 20. In particular, since the bearing 27 receives the compressive reaction force, mechanical losses are reduced further.

This invention can also be embodied as follows.

Although this embodiment includes a fixed displacement single-headed swash plate type multistage piston compressor, the invention may be applied also to a variable displacement swash plate type multistage piston compressor or to a double-headed type multistage piston compressor. Of course, the invention is not limited to swash plate type compressor and it may be applied also to a wave cam type multistage piston compressor.

The present invention may be applied to a compressor that is connected with and driven by an external drive source such as a vehicular engine through a clutch mechanism such as an electromagnetic clutch.

The motor chamber 29 may not communicate with the crank chamber 30. Further, a radial bearing may be provided between the swash plate 22 and the front housing member 12.

Although the pressures acting on the rear faces of the pistons 25, 26 are almost equal to the pressure of the refrigerant compressed in the first bore 13*b* here, the pressures acting on the rear faces of the pistons 25, 26 may be any pressures higher than the suction pressure and lower than the discharge pressure. Of course, the present invention may be applied not only to such a two-stage compressor as in the above embodiment but also to a multistage compressor of three or more stages. Further, a plurality of pairs of bores may be provided.

As the refrigerant, in place of carbon dioxide, another refrigerant gas, e.g., ammonia or propane gas may be used.

What is claimed is:

1. A multistage piston compressor comprising:

a housing;

a suction chamber located in the housing, wherein the pressure in the suction chamber is a suction pressure;

a discharge chamber located in the housing, wherein the pressure in the discharge chamber is a discharge pressure;

a rotary shaft supported in the housing;

a plurality of bores formed in the housing at predetermined angular intervals about the axis of the shaft;

a valve plate located in the housing, wherein the valve plate includes a suction port and a discharge port corresponding to each bore;

a piston housed in each bore, wherein each piston reciprocates and compresses a refrigerant when the shaft is rotated;

compression chambers defined in each bore between a rear end of the associated piston and the valve ate, wherein the compression chambers include a first compression chamber and a second compression chamber;

an intermediate chamber connecting the discharge port of the first compression chamber to the suction port of the second compression chamber, wherein the refrigerant is compressed in stages and flows from the first compression chamber to the second compression chamber through the intermediate chamber;

a crank chamber formed within the housing, wherein each piston has a front end opposite to the rear end and exposed in the crank chamber, and a passage for connecting the intermediate chamber with the crank chamber such that the pressure of the intermediate chamber is applied to the crank chamber and acts on the front ends of the postions, herein the pressure of the intermediate chamber is between the suction pressure and the discharge pressure.

2. The multi-stage piston compressor of claim 1 comprising:

a crank mechanism located in the crank chamber, wherein the crank mechanism converts rotation of the shaft to reciprocating motion for driving the pistons.

3. The multi-stage piston compressor of claim 2 comprising:

a swash plate fixe to the shaft; and shoes coupled to each piston, wherein the shoes contact the swash plate and transmit force between the swash plate and the pistons.

4. The multi-stage piston compressor according to claim 2 comprising:

a motor chamber; and electric motor for driving the shaft, wherein the motor is located in the motor chamber.

5. The multi-stage piston compressor according to claim 2 comprising:

a motor chamber;

an electric motor for driving the shaft, wherein the motor is located in the motor chamber; and a bearing for receiving thrust force transmitted from the swash plate, wherein the bearing is located in the crank chamber and is adjacent to the motor chamber.

6. The multi-stage piston compressor of claim 1 wherein the plurality of bores is first bore located upstream of the intermediate chamber and a second bore located downstream of the intermediate chamber.

7. A multistage piston compressor comprising:

a housing;

a suction chamber located in the housing, wherein the pressure in the suction chamber is a suction pressure;

a discharge chamber located in the housing, wherein the pressure in the discharge chamber is a discharge pressure;

a rotary shaft supported in the housing;

a plurality of bores formed in the housing at predetermined angular intervals about the axis of the shaft;

a valve plate located in he housing, wherein the valve plate includes a suction port and a discharge port corresponding to each bore;

a piston housed in each bore, wherein each piston reciprocates and compresses a refrigerant when the shaft is rotated, wherein each piston has a rear end and a front end, the front end being opposite to the rear end;

compression chambers defined in each bore between a rear end of the associated piston and the valve plate, wherein the compression chambers include a first compression chamber and a second compression chamber;

an intermediate chamber connecting the discharge port of the first compression chamber to the suction port of he second compression chamber, wherein the refrigerant is compressed in stages and flows from the first compression chamber to the second compression chamber through the intermediate chamber and the pressure of the intermediate chamber is between the suction pressure and the discharge pressure; and a passage connected to the intermediate chamber for applying the pressure of the intermediate chamber to the front ends of the pistons.

8. The multi-stage piston compressor of claim 7 comprising:

a crank chamber formed within the housing, wherein the pressure of the crank chamber is set approximately to he pressure of the intermediate chamber by the passage; and a crank mechanism located in the crank chamber, wherein the crank mechanism converts rotation of the shaft to reciprocating motion for driving the pistons.

9. The multi-stage piston compressor of claim 8 comprising:

a swash plate fixe to the shaft; and shoes coupled to each piston, wherein the shoes contact the swash plate and transmit force between the swash plate and the pistons.

10. The multi-stage piston compressor according to claim 9 further comprising:

a motor chamber;

an electric motor for driving the shaft, wherein the motor is located in the motor chamber; and a bearing for receiving thrust force transmitted from the swash plate, wherein the bearing is located in the crank chamber and is adjacent to the motor chamber.

11. The multi-stage piston compressor of claim 7 wherein the plurality of bores is first bore located upstream of the intermediate chamber and a second bore located downstream of the intermediate chamber.

* * * * *

UNITED STATES PATENT AND TRADEMARK OFFICE

CERTIFICATE OF CORRECTION

PATENT NO. : 6,632,074 B2
DATED : October 14, 2003
INVENTOR(S) : Kazuo Murakami et al.

It is certified that error appears in the above-identified patent and that said Letters Patent is hereby corrected as shown below:

Column 3,
Line 53, please delete “co pressed” and insert therefore -- compressed --

Column 5,
Line 8, please delete “ate” and insert therefore -- plate --
Line 24, please delete “herein” and insert therefore -- wherein --
Line 42, please insert -- an -- in front of “electric”
Line 53, please insert -- a -- after “is”

Column 6,
Line 42, please delete “fixe” and insert therefore -- fixed --

Signed and Sealed this

Twentieth Day of January, 2004

JON W. DUDAS
*Acting Director of the United States Patent and Trademark Office*